US006588036B1

(12) United States Patent
Hort

(10) Patent No.: US 6,588,036 B1
(45) Date of Patent: Jul. 8, 2003

(54) BED ROLL

(76) Inventor: Ora Hort, 3 Topaz Ct., Montebello, NY (US) 10901

( * ) Notice: Subject to any disclaimer, the term of this patent is extended or adjusted under 35 U.S.C. 154(b) by 0 days.

(21) Appl. No.: 10/104,535

(22) Filed: Mar. 25, 2002

(51) Int. Cl.[7] ..... A47G 9/06

(52) U.S. Cl. ..... 5/417; 5/420; 5/419; 5/413 R; 5/502

(58) Field of Search ..... 5/417, 419, 420, 5/413 R, 425, 502, 655

(56) References Cited

U.S. PATENT DOCUMENTS

| | | | | | |
|---|---|---|---|---|---|
| 2,264,471 | A | * | 12/1941 | Glenn | 5/419 |
| 3,774,249 | A | * | 11/1973 | Ybarra et al. | 5/419 |
| 4,063,319 | A | * | 12/1977 | Smith et al. | 5/502 |
| 4,671,393 | A | * | 6/1987 | Rainey | 190/1 |
| 4,709,430 | A | * | 12/1987 | Nicoll | 5/417 |
| 5,103,514 | A | * | 4/1992 | Leach | 5/417 |
| 5,203,041 | A | * | 4/1993 | Alonso | 5/420 |
| 5,206,964 | A | * | 5/1993 | Wilson, Sr. | 5/417 |
| 5,401,600 | A | * | 3/1995 | Aizawa et al. | 430/65 |
| 5,966,757 | A | * | 10/1999 | Sullivan | 5/417 |
| 6,105,188 | A | | 8/2000 | Perez-Mesa | |
| 6,141,805 | A | * | 11/2000 | Fisher-Cohen et al. | 5/420 |
| 6,199,232 | B1 | * | 3/2001 | Kocivar | 5/502 |

* cited by examiner

*Primary Examiner*—Michael F. Trettel
(74) *Attorney, Agent, or Firm*—Stanley J. Yavner

(57) ABSTRACT

A bed roll combination, particularly for children, is shown to include a mattress, with a mattress cover sheet and a top sheet, if necessary, as well as a blanket. The blanket is also used as the carrying bag for the combination, with rings or the like, for attaching a carrying strap. Alternatively, the above combination, for carrying, is placed in a separate carrying bag, also with facility for attaching a carrying strap.

6 Claims, 3 Drawing Sheets

FIG.1
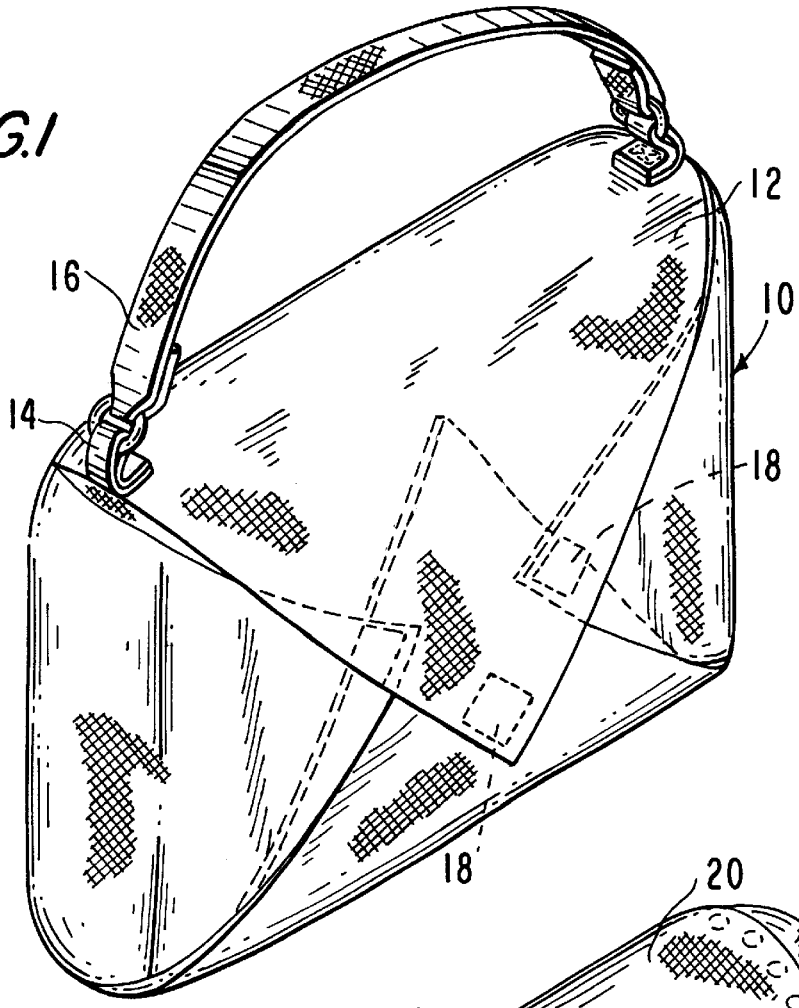
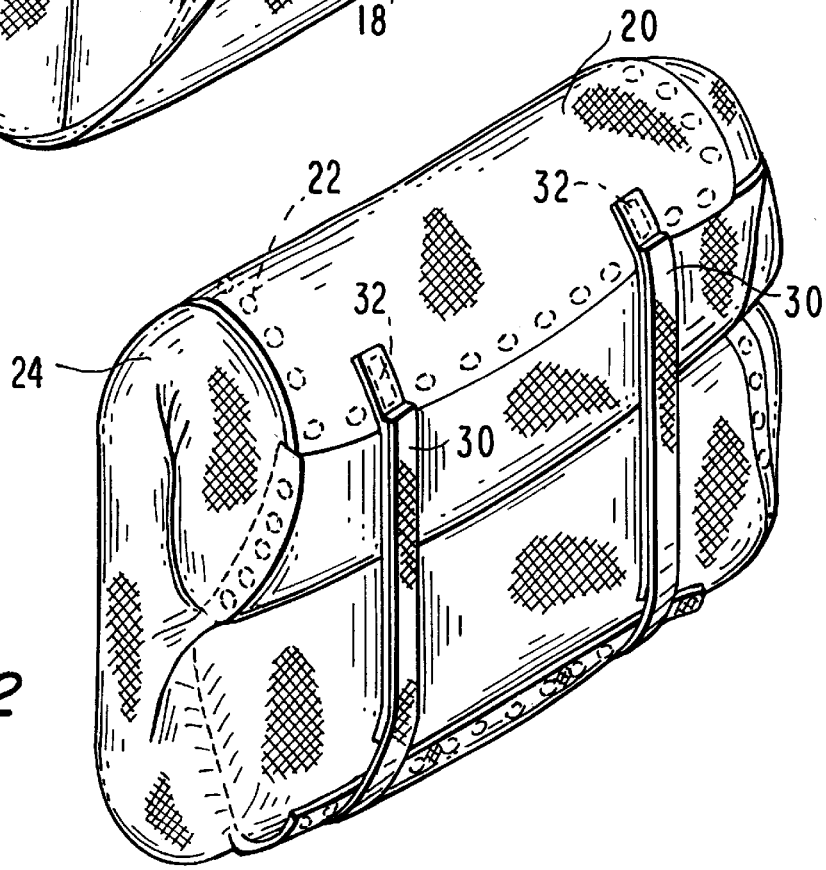
FIG. 2

BED ROLL

FIELD OF THE INVENTION

This invention relates to a bed roll combination with elements for carrying the combination and for providing a portable bed having a blanket and a mattress with a cover sheet.

BACKGROUND OF THE INVENTION

During the past half century or more a portable bed requirement was answered, as to the need, by what is commonly known as a sleeping bag. As convenient as it was, the sleeping bag, in its usual configuration, was bulky and did not usually provide either a pillow, a sheet or a separate blanket. As to the bulkiness, the materials available today have more or less provided an opporturnity for reducing the chore of carrying and using the sleeping bag. For instance, the use of polyester or like available fills provides this reduction.

One such advancement over the sleeping bag is presented in a patent granted to Perez-Mesa in U.S. Pat. No. 6,105,188. Perez-Mesa provided a separate carrying pouch with provisions for carrying a base blanket and a cover blanket. Essentially, Perez-Mesa's design presented a nap-sac carrying pouch in a form to be carried by the child. The presentation by Perez-Mesa in her patent provided only two blankets and a carrying pouch, and was not presented in a design convenient and comfortable for overnight sleeping for a child. For instance, in fairness, Perez-Mesa disclosed a pillow for fitting in a pouch formed on the outside of the carrying bag releasably secured to the outer carrying bag. Furthermore, Perez-Mesa envisions the option of coupling the outer carrying bag and blankets to an underlying cot, but without providing a mattress with a cover, and which requires folding in a certain manner in order to be useful. Accordingly, Perez-Mesa is essentially providing the usual sleeping bag, but with a variation from the usual configuration for such sleeping bags.

Therefore, the Perez-Mesa structure and design does not provide the satisfaction of the objects of the present invention or the structure and convenience thereof.

OBJECTS AND SUMMARY OF THE INVENTION

Accordingly, a primary object of the present invention is to provide a bed roll, which enables convenient overnight sleeping for a child or even an adult, and which includes a mattress, a blanket, a mattress cover sheet, and an attachable strap to enable convenient carrying and storage within the blanket thereof;

A further and more particular object is to provide the above combination with a cover sheet for the mattress and a pillow, all of which is conveniently rolled within the blanket for convenient carrying;

Another object of the present invention is to provide a bed roll in a form which is convenient to use and carry, whereby very young children can use the bed roll of the invention, without being required to fold in a certain manner or to carry a heavy or bulky item; and A final object of the present invention is to provide a bed roll combination, including a mattress which fully replaces the need for a portable crib or bed useful for overnight sleeping.

These and other objects of the present invention are provided in a bed roll which features the combination of a blanket for use in encasing and carrying the entire balance of the combination therewithin. The balance of the combination includes a mattress, with a water-resistant (optional) cover sheet, a top sheet and an attachment to the blanket for enabling connection of a carrying strap. In one alternative embodiment for the invention, a Velcro closure is provided on an outer carrying bag to enable the blanket to encase the balance of the combination within the outer carrying bag, which also includes a detachable carrying strap. In a further alternative embodiment, bumpers for placement within the blanket during carrying, and for attachment to the bottom floor mat, are provided as an additional element for the combination.

BRIEF DESCRIPTION OF THE DRAWINGS

Other objects, features and advantages of the present invention will become apparent by a detailed description of a preferred, but nonetheless illustrative, embodiment, and alternative embodiments, with reference to the accompanying drawings, wherein:

FIG. 1 is an isometric view of the blanket of the present invention, folded for carrying with a detachable strap;

FIG. 2 shows an isometric view of the mattress, the mattress cover sheet, the bottom floor mat, with bumpers as an alternative embodiment, as would be placed with a pillow in the FIG. 1 blanket for carrying;

DETAILED DESCRIPTION OF THE PREFERRED AND ALTERNATIVE EMBODIMENTS

Figure 3:
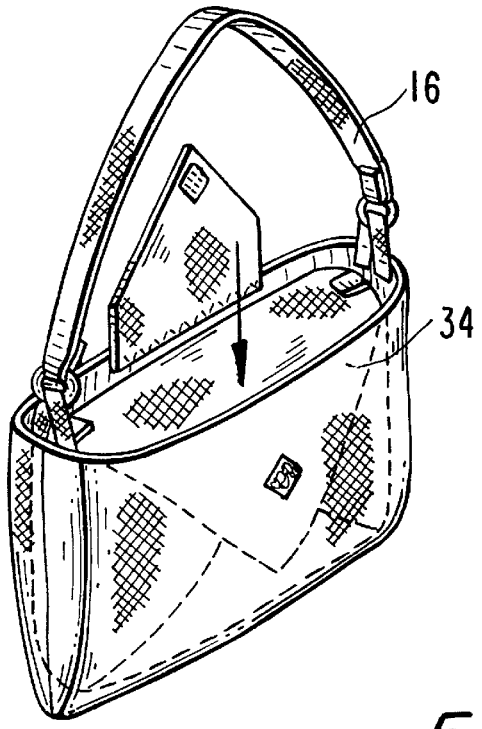
FIG. 3 is an isometric view of a separate carrying bag for use with a detachable strap and for carrying the FIG. 1 combination.

FIG. 1 shows the preferred embodiment of the combination bed roll, generally designated 10, of the present invention. The combination bed roll 10 includes a blanket 12, shown in FIG. 1 in its carrying configuration with attached rings—ring holder elements 14, for detachable connection with carrying strap 16. As may be seen from FIG. 1, the corners of blanket 12 enable Velcro connections 18 for attaching such corners to each other to enable carrying of the combination.

Figure 4:
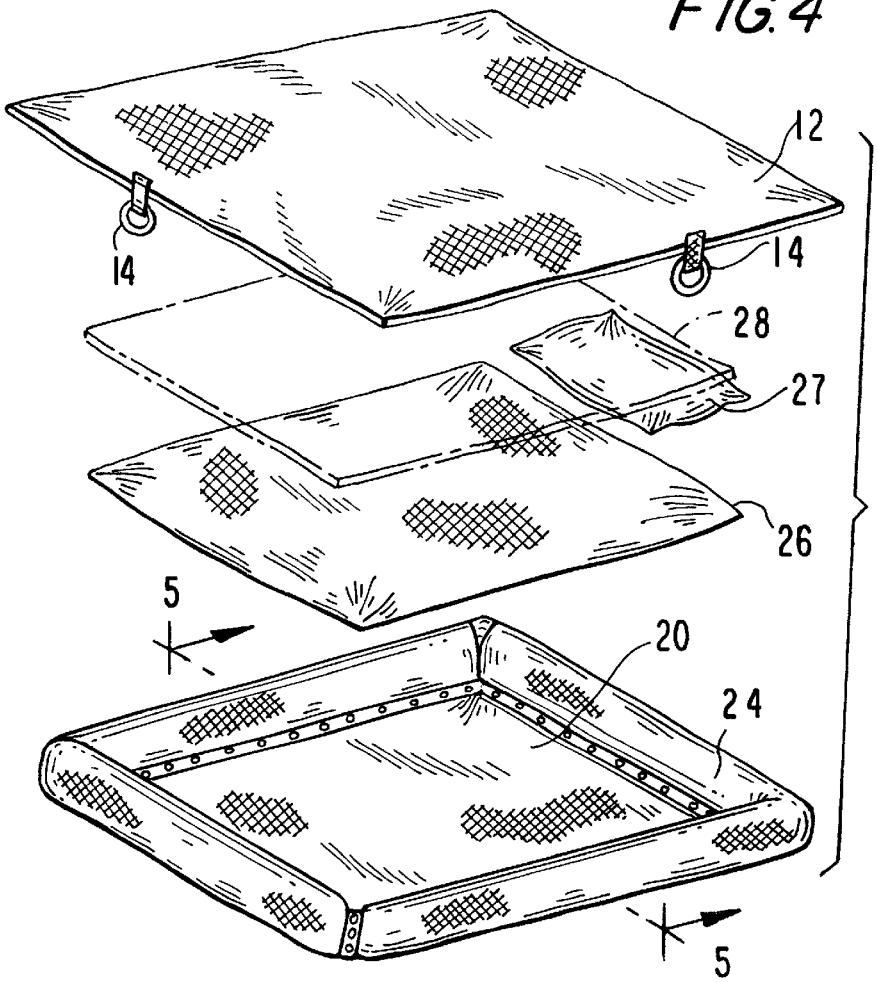
FIG. 4 is a exploded view of the combination (except detachable strap) of FIG. 1, showing from top to bottom, a blanket with facility for attachment of the carrying strap, a mattress with a cover sheet, and a bottom floor mat with attached bumpers pursuant to an alternative embodiment thereof; a top sheet is also shown in ghost lines, for use with the combination, according to the present invention.

FIG. 2 shows an isometric view of the combination of elements that are placed within the blanket 12 of FIG. 1 for carrying. Such FIG. 2 combination of elements includes a bottom floor mat 20 with snaps 22 for attachment of bumpers 24, the bumpers representing an alternative embodiment of the present invention, which in its preferred embodiment, includes floor mat 20, but without bumpers 24. When bumpers 24 are included, there is of course, also included for placement in blanket 12, the mattress and mattress cover sheet combination 26 as shown in FIG. 4. As an optional accessory for inclusion within blanket 12, a top sheet 28, is shown in ghost lines in the exploded view of FIG. 4. A pillow 27 is also included.

FIG. 2 also illustrates the use of straps 30, and for instance, Velcro receptor pads 32, for encasing securely the subcombination of mattress with cover sheet 26, pillow (optional), bottom floor mat 20 and bumpers 24 (alternative embodiment), all to be placed within blanket 12, with its carrying strap 16, as shown in FIG. 1. The cover sheet for the mattress may be water-resistant.

FIG. 3 represents a still further alternative embodiment, in terms of an outer carrying bag 34 for enclosing and carrying the entire FIG. 1 combination, except for the carrying strap 16, in this alternative embodiment now attached to outer carrying bag 34.

Figure 5:
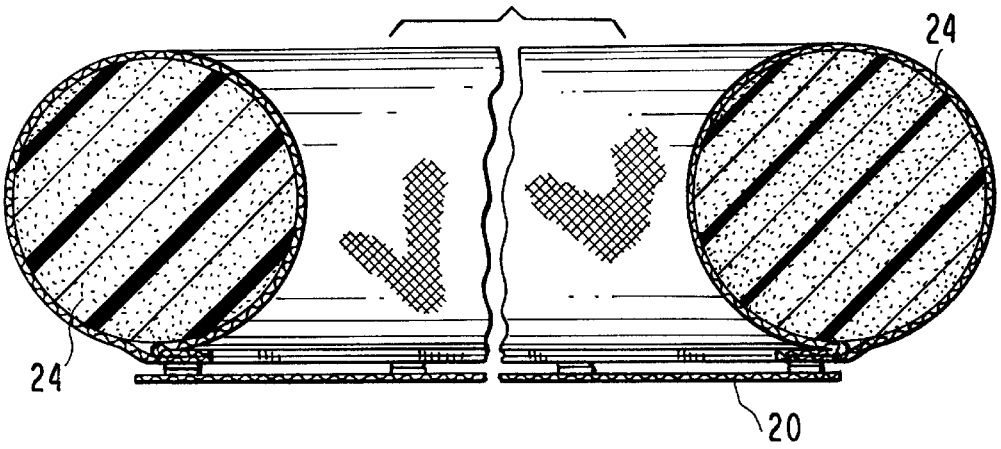
FIG. 5 is a sectional view, taken along the line 5—5 of FIG. 4, and showing the floor mat with attached bumpers therefor.

FIG. 5 is a sectional view of part of FIG. 4, and shows bottom floor mat 20 in an attached position with respect to bumpers 24, but all compressed for ease of representation, in terms of the width thereof.

Figure 6:
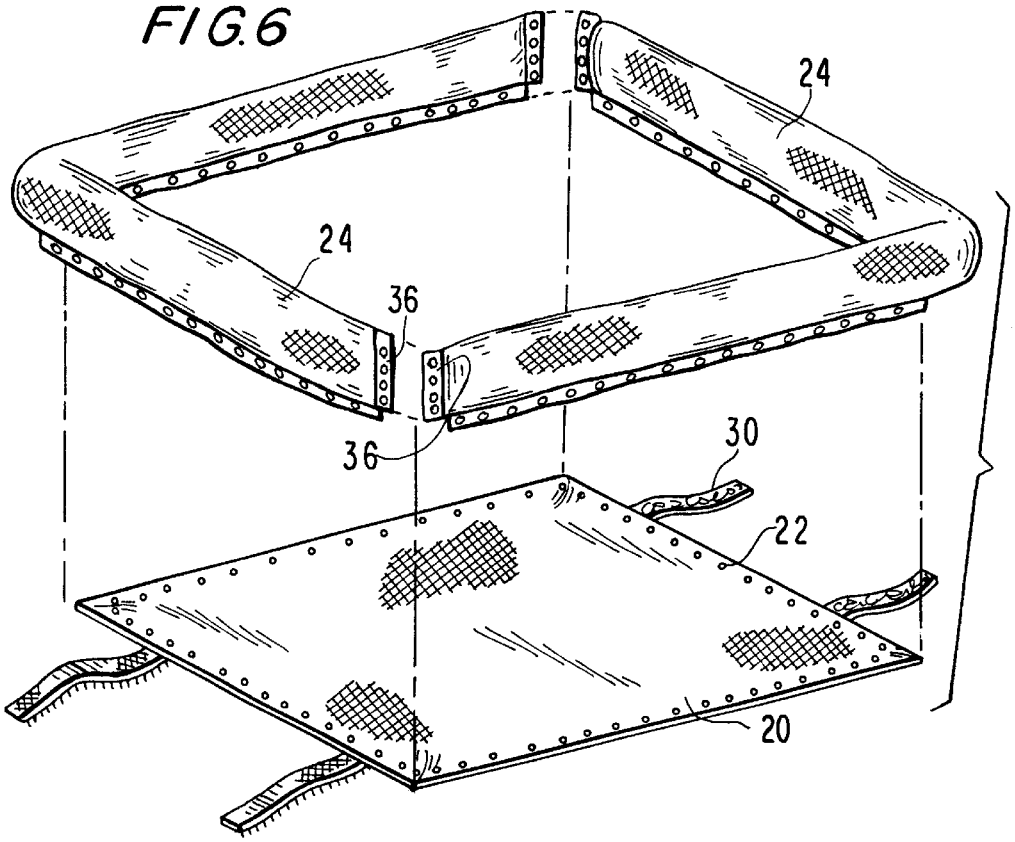
FIG. 6 is an exploded view of the bottom element of FIG. 4 to show how the bumpers are removable from the floor mat.

FIG. 6 shows an exploded view of bumpers 24 and bottom floor mat 20, with its snaps 22 and straps 30; but FIG. 6 further provides a clear representation of how bumpers 24 are detachable by means of second snaps 36 or the like, for connecting one section of bumpers 24 to another.

Therefore, a preferred embodiment uses blanket 12 as the carrying means, with straps 16, for the subcombination bed roll elements including floor mat 20 (optional), mattress with water-resistant mattress cover sheet 26, and top sheet 28 (optional). A pillow 27 may also be included. In an alternative embodiment, bottom floor mat 20, with attached securement straps 30, is also attached to bumpers 24, for inclusion with mattress and mattress cover sheet 26 in blanket 12 as the carrying means, with strap 16 (FIG. 1). In still another alternative embodiment, an outer carrying bag 34 is provided as the carrying means, with straps 16 attached thereto, and blanket 12 and other elements therewithin.

While preferred and alternative embodiments have been described in detail in the foregoing, the invention hereof is only to be limited by the following claims:

What is claimed is:

1. A portable bed roll, particularly for children, comprising, in combination, a generally rectangular blanket, strap attachment elements affixed to said blanket, and a subcombination of a mattress and mattress cover sheet for carrying within said blanket, with said blanket being compactly foldable and having securement means enabling ease of portability of said combination, said securement means providing detachably fixing said blanket so that the corners thereof are attachable, one to another.

2. A portable bed roll according to claim 1, wherein said subcombination further comprises a bottom floor mat for use beneath said mattress and said mattress cover sheet, and a pillow, when said combination is deployed for use by a sleeping child.

3. A portable bed roll according to claim 2, wherein bumpers are provided, attachable and detachable with said bottom floor mat.

4. A portable bed roll according to claim 1, wherein an outer carrying bag is provided to enable carrying of said combination, said bag having strap attachment elements affixed thereto, and including a strap for carrying thereof.

5. A portable bed roll according to claim 2, wherein said combination is deployable as a bed, with said bottom floor mat spread, said mattress and mattress cover sheet upon said mat and spread, and said blanket spread upon said mattress cover sheet with said pillow therebetween.

6. A portable bed roll according to claim 3, wherein said combination is deployable as a bed for a small child, with said bottom floor mat spread, said bumpers attached with said mat, and said mattress and mattress cover sheet spread upon said mat.

* * * * *